US009803810B2

(12) United States Patent
Vamberi

(10) Patent No.: US 9,803,810 B2
(45) Date of Patent: Oct. 31, 2017

(54) METHOD AND APPARATUS FOR ROTATIONAL ADJUSTMENT OF OPTICS

(71) Applicant: Gabor Vamberi, Leesburg, VA (US)

(72) Inventor: Gabor Vamberi, Leesburg, VA (US)

( * ) Notice: Subject to any disclaimer, the term of this patent is extended or adjusted under 35 U.S.C. 154(b) by 208 days.

(21) Appl. No.: 14/764,814

(22) PCT Filed: Jan. 31, 2014

(86) PCT No.: PCT/US2014/014147
§ 371 (c)(1),
(2) Date: Jul. 30, 2015

(87) PCT Pub. No.: WO2014/121071
PCT Pub. Date: Aug. 7, 2014

(65) Prior Publication Data

US 2015/0369430 A1 Dec. 24, 2015

Related U.S. Application Data

(60) Provisional application No. 61/759,019, filed on Jan. 31, 2013.

(51) Int. Cl.

| | |
|---|---|
| ***F21V 5/04*** | (2006.01) |
| ***F21V 14/06*** | (2006.01) |
| ***F21K 99/00*** | (2016.01) |
| ***F21V 14/00*** | (2006.01) |
| ***F21V 5/08*** | (2006.01) |
| ***F21V 17/02*** | (2006.01) |

(Continued)

(52) U.S. Cl.
CPC ..... *F21K 9/58* (2013.01); *F21V 5/08* (2013.01); *F21V 14/00* (2013.01); *F21V 14/06* (2013.01); *F21V 17/02* (2013.01); *F21W 2131/103* (2013.01); *F21W 2131/105* (2013.01); *F21Y 2115/10* (2016.08)

(58) Field of Classification Search
CPC ..... F21V 14/00; F21V 14/06; F21V 17/02; F21V 5/08; F21V 19/02; F21V 14/02; F21W 2131/103; F21W 2131/105
See application file for complete search history.

(56) References Cited

U.S. PATENT DOCUMENTS 4,893,224 A * 1/1990 Tinley ..... F21V 19/02 362/287
5,523,932 A 6/1996 Bogdanovs
(Continued)

FOREIGN PATENT DOCUMENTS

WO WO 2012/028220 3/2012

*Primary Examiner* — Peggy Neils
(74) *Attorney, Agent, or Firm* — Diederiks & Whitelaw, PLC

(57) ABSTRACT

A method and apparatus is provided that enables the rotational adjustment of a non rotationally-symmetrical optical element in order to change the direction of the emitted light from an LED emitter of a lighting unit or to change the overall luminous distribution pattern in a luminaire including a plurality of LED emitters and optical elements. The apparatus enables simple and accurate rotational adjustment, while providing for the retaining of the selected rotational position of the optical element. The adjustment can be made before or after the installation of the lighting unit or luminaire, and can be accomplished without requiring tools and expert personnel.

20 Claims, 5 Drawing Sheets

(51) Int. Cl.

| | |
|---|---|
| *F21W 131/103* | (2006.01) |
| *F21W 131/105* | (2006.01) |
| *F21Y 115/10* | (2016.01) |

(56) References Cited

U.S. PATENT DOCUMENTS

| | | | | |
|---|---|---|---|---|
| 6,193,395 | B1 | 2/2001 | Logan | |
| 7,163,329 | B2 * | 1/2007 | Bina | E04B 9/006 362/147 |
| 7,303,327 | B2 | 12/2007 | Copeland et al. | |
| 7,490,978 | B2 | 2/2009 | Crisci | |
| 8,393,759 | B2 * | 3/2013 | Huang | F21V 14/06 362/270 |
| 2007/0058378 | A1 | 3/2007 | Moriyama et al. | |
| 2009/0296390 | A1 * | 12/2009 | Dubord | B60Q 1/24 362/240 |
| 2010/0265716 | A1 | 10/2010 | Hood et al. | |
| 2012/0268920 | A1 | 10/2012 | Matthews et al. | |

* cited by examiner

METHOD AND APPARATUS FOR ROTATIONAL ADJUSTMENT OF OPTICS

CROSS-REFERENCE TO RELATED APPLICATIONS

The present application represents a National Stage application of PCT/US2014/014147 entitled "Method and Apparatus for Rotational Adjustment of Optics" filed Jan. 31, 2014 which claims the benefit of U.S. Provisional Patent Application Ser. No. 61/759,019 entitled "Method and Apparatus for Rotational Adjustment of Optics" filed Jan. 31, 2013. The entire content of this application is incorporated herein by reference.

BACKGROUND OF THE INVENTION

This invention is related generally to the field of lighting, and in particular to the rotational adjustment of non rotationally-symmetrical optical elements in LED emitter lamped luminaires.

Asymmetrical or otherwise non rotationally-symmetrical light distribution is a frequently utilized feature in LED luminaires, such as in luminaires for the lighting of highways, roadways and walkways, parking garage luminaires, gas station luminaires, certain floodlights, downlights, aisle lighters in supermarkets and warehouses, tunnel lights, and the like. Particular distribution patterns are typically produced by dedicated optical elements, or made adjustable through various mechanical features of the luminaire, which typically involve the tilting and/or rotating of the LED emitter together with the optical element. Incorporation of these types of adjustable features may impact on various luminaire functions, including the thermal management of the luminaire. Adjustment of the features typically requires tools.

In certain applications, the rotational adjustment of non rotationally-symmetrical optics might be a viable method for modifying the luminaire's default luminous distribution pattern. Rotational adjustability of non rotationally-symmetrical optics can simplify luminaire design, and can significantly broaden luminaire functionality. Simple, toolless adjustability provides practical and economic benefits, and adjustment-aiding graphic features provide for accuracy.

SUMMARY OF THE INVENTION

It is an object of this invention to provide for adjustability of the luminous distribution pattern of luminaires and thereby enabling post manufacturing, and post-installation change of the luminous distribution pattern in accordance with a broad variety of needs.

Another object of this invention is to provide a simple method of adjustability that in some cases does not require expert personnel.

Another object of this invention is to provide a rotatably adjustable apparatus, which can be adjusted without tools.

Another object if this invention is to provide for accuracy of the adjustment by incorporating adjustment aiding graphic features.

It is another object of this invention to provide an apparatus that retains the optical element in the adjusted position by mechanical means, and maintains the desired setting under expected operating conditions.

Further object of this invention is to enable manufacturers to simplify luminaire design, and achieve different light distribution patterns with fewer components which are adjustable, instead of utilizing a plurality of dedicated, non-adjustable components.

These and other objects of the invention are achieved by providing an optical element, either in a lighting unit having a single optical element or a luminaire including multiple optical elements, which can be selectively, rotationally adjusted, without the need for tools, in order to alter the direction of the light for the lighting unit or alter the light distribution or dispersion pattern associated with the luminaire in a convenient manner. More specifically, a method and apparatus are provided that enables the rotational adjustment of a non rotationally-symmetrical optical element in order to change the direction of the emitted light from an LED emitter of a lighting unit or to change the overall luminous distribution pattern in luminaires having a plurality of LED emitters and optical elements. The invention enables simple and accurate rotational adjustment, while providing for the retaining of the selected rotational position of the optical element. The adjustment can be made before or after the installation, and can be accomplished without requiring tools and expert personnel.

Additional features and advantages of the invention will become more readily apparent from the following detailed description of the invention with reference to the accompanying drawings wherein like reference numerals refer to corresponding parts in the several views.

DETAILED DESCRIPTION OF THE INVENTION

For the purposes of this invention, "LED emitter" is a COB (chip-on-board) type LED module, a single SMD (surface mounted device) type LED, or an array comprising a plurality thereof, and the like. In addition, as used herein, "optical element" is a non rotationally-symmetrical or asymmetrical optic that is a spun, stamped, or fabricated metal reflector, an injection molded plastic reflector, a TIR (Total Internal Reflection) type optic, glass or plastic lens type optic, a Fresnel lens type optic, a light shaping diffuser, an otherwise symmetrical optic or light filter with non rotationally-symmetrical color features, and the like.

This invention is concerned with the luminaire-integration and functionality of non rotationally-symmetrical optical elements, in that it provides for rotational adjustment of the optical elements. The rotatable mode of the rotational adjustment can be multi-click type in predetermined intervals, or smooth, without pre-determined intervals.

Figure 1:
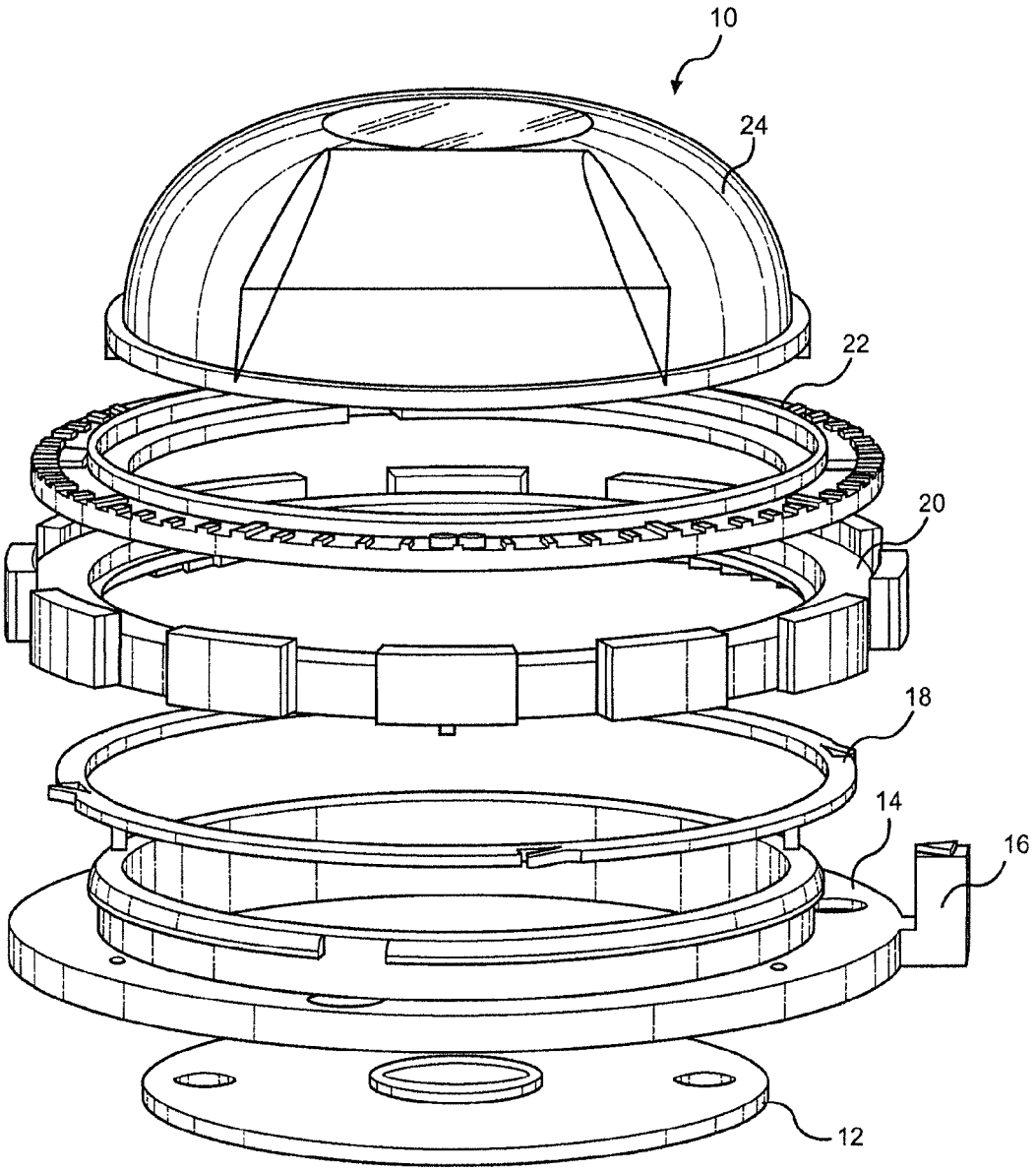
FIG. 1 is an exploded view illustration of the optical element and the apparatus that provides for the rotational adjustment of the optical element in a preferred embodiment.
Figure 2:
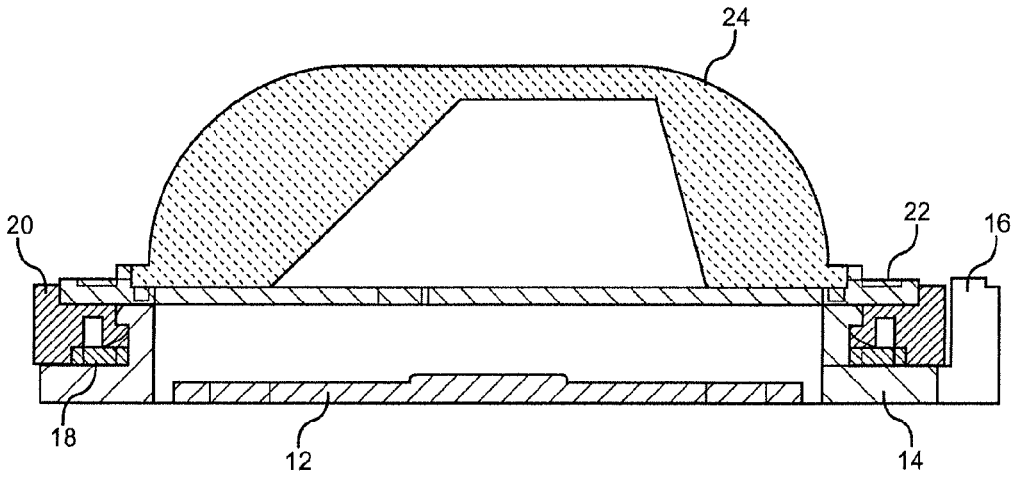
FIG. 2 is a cross-sectional view of a schematic representation of the optical element and the apparatus that provides for the rotational adjustment of the optical element.

With initial reference to FIGS. 1 and 2, there is shown a lighting unit 10 including an LED emitter 12 configured to be rigidly attached to a luminaire housing or to a heat-sink (not shown in these figures). In the embodiment shown, lighting unit 10 also includes a ring 14 having a zero-position indicating feature 16, a separate wreath 18, a bezel 20, a position indicating dial 22 and a non rotationally-symmetrical optical element 24. At this point, it should be noted that each of ring 14, wreath 18 and bezel 20 can be made of various suitable materials including, but not limited to, metal or plastic material. More importantly, as will be detailed fully below, the invention allows for rotational adjustment of non rotationally-symmetrical or asymmetric optical element 24.

In the preferred embodiment shown in these figures, optical element 24 is rigidly attached to bezel 20. On the other hand, bezel 20 is mounted for rotation relative to ring 14, which is rigidly attached directly to a luminaire housing or to a heat-sink, or indirectly attached to the housing or heat-sink through attachment features that may be provided on an LED emitter, or on a luminaire-integrating interface of the LED emitter or emitter module. In any case, the ring 14 and bezel 20 are concentrically positioned around a central axis, which is centered on and perpendicular to the light emitting surface of the LED emitter 12. Therefore, the axis of rotation of bezel 20 is also the axis of the emitting surface of LED emitter 12. Most preferably, rotatable adjustment of bezel 20 facilitates angular, i.e., up to 360 degree rotational, adjustment of optical element 24 relative to the permanently stationary position of LED emitter 12 and ring 14.

In the preferred embodiment of this invention, lighting unit 10 also incorporates mechanical features and components which allow for rotatable, elastic engagement between adjustable bezel 20 and the rigidly attached ring 14 in predetermined, rotation-angular intervals. In a preferred embodiment shown in FIG. 3, the ring-facing side of bezel 20 includes an inward-facing gear feature of recesses and projections (not separately labeled) at predetermined regular angular intervals. The gear feature is concentric with bezel 20 and is preferably an integral feature of bezel 20, i.e., is formed as part of bezel 20.

Figure 3:
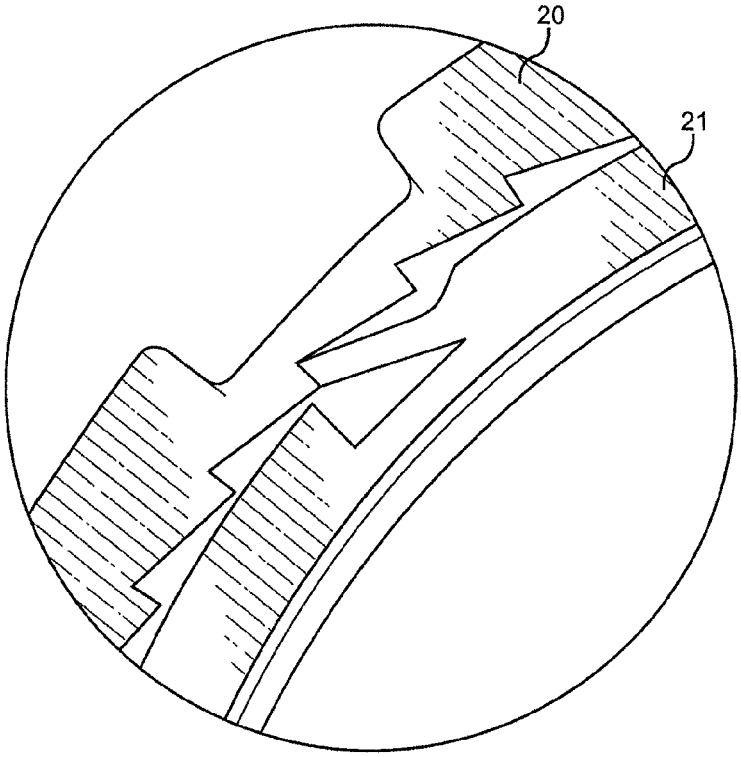
FIG. 3 is a partial plan view illustration of the mechanical engagement between a spring projection of the wreath and a recess on the gear feature of the bezel.

Wreath 18 is rigidly attached to the bezel-facing side of ring 14 and includes an outward-cantilevered spring projection (sprung tooth or pawl), or preferably a plurality thereof as illustrated in FIG. 3 but not separately labeled. The spring projection, or the plurality thereof, function to elastically bend in the direction of the rotation when engaged by the projections of the inward-facing gear feature of the rotating bezel 20. When released, the spring projections elastically extend into the recesses of the gear feature, thereby retaining the position of bezel 20. In this sense, a detent mechanism is provided to enable various rotational positions to be established for bezel 20 and to retain bezel 20 in any select one of these rotational positions such that, under expected operating conditions, the selected rotational position of bezel 20 is maintained until a further deliberate adjustment is made. Actually, the rotatable adjustment of bezel 20 can be of the ratchet-type such that bezel 20 can be rotated uni-directionally for adjustment purposes, or bi-directional rotation can be provided to allow both clockwise and counter-clockwise adjustment.

In the embodiment shown, repeated elastic engagement between the spring projections of wreath 18 and the position retaining recesses of the gear feature of bezel 20 preferably imparts a click-type feedback upon the adjusting person. The click-type feedback is both audible and tactile. The number of projections and recesses of the gear feature determines the degree of the intervals in which bezel 20 engages wreath 18 and ring 14. For example, a circular division into sixty projections and recesses establishes adjustability in six degree intervals, while a division into thirty projections and recesses establishes adjustability in twelve degree intervals. While the above describes particular constructions and methods for achieving elastic engagement, it is to be understood that alternative arrangements and methods that yield elastic engagement can also be employed and are included within the scope of the present invention, with the alternative structure and methods resulting in similar, intervallic adjustment, or smooth adjustment without predetermined intervals.

In the depicted embodiment, position indicating dial 22 is rigidly attached to the visible face of bezel 20. The dial 22 comprises graphic markings that display apparatus specific, intervallic rotation-angular divisions, starting with a clearly indicated zero degree marking. In addition, ring 14 includes the zero-position indicating feature 16, which can be rigidly attached to ring 14 or constituted by a contiguous part thereof. In simplest form, the zero-position indicating feature 16 comprises a single graphic marking that clearly denotes the zero-position. In the zero-position setting, a zero degree marking of dial 22 lines up with the graphic marking on the zero-position indicating feature 16 of ring 14.

The zero-position of optical element 24 in lighting unit 10 is determined by the overall design, with the manufacturer installing optical element 24 in bezel 20, and the overall assembly in the lighting unit 10 in accordance with the design. Therefore, the zero-position setting of optical element 24 is the default position for the lighting unit 10, with this positioning being adjustable on an as-needed basis, prior to, and/or following installation in accordance with the invention. When rotating bezel 20, dial 22 also rotates, and the position of the graphic markings thereof relative to the marking on the zero-position indicating feature 16 of ring 14 provides a simple graphic indication of the degree of rotational departure from the default zero-position.

Figure 4A:
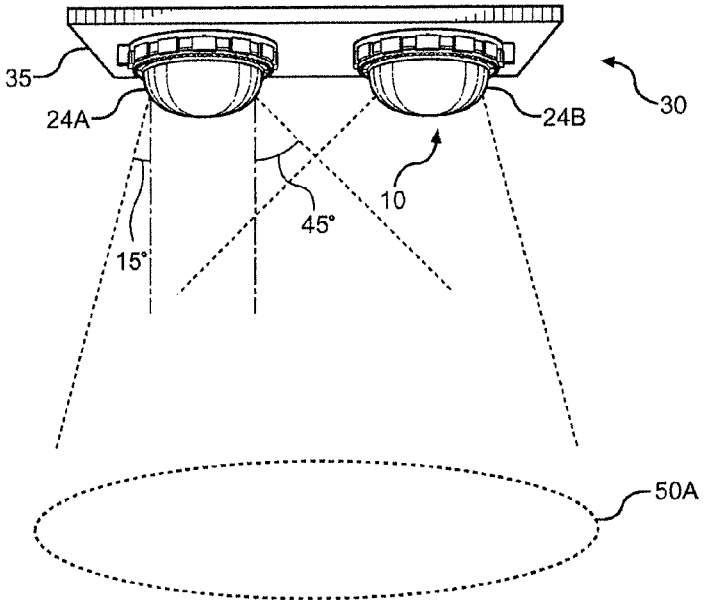
FIGS. 4A-4D illustrate different potential positions for rotationally adjustable optical elements to establish different dispersion patterns for a luminaire in accordance with the invention.
Figure 4B:
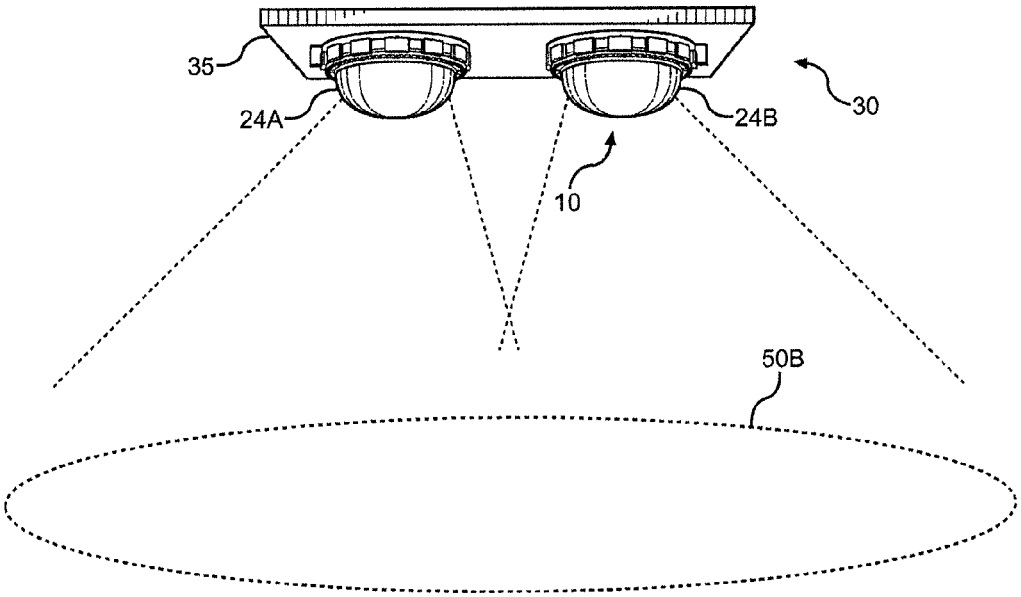
Figure 4C:
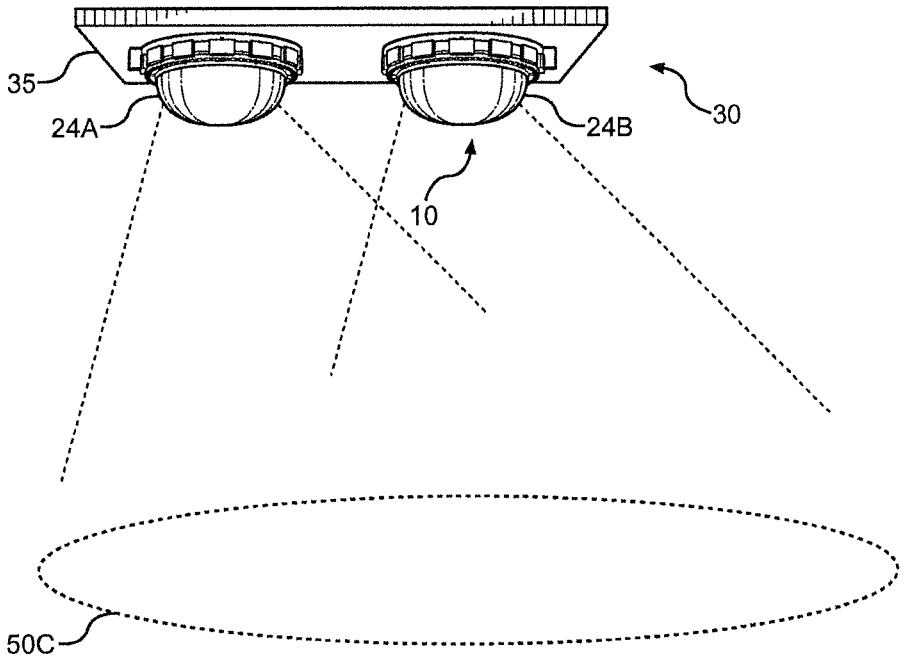

With the above construction, optical element 24 can be rotatably adjusted, particularly manually without the need for tools, to conveniently alter the direction of the light emitted from lighting unit 10. In addition, a luminaire can be constructed to incorporate a plurality of lighting units 10, with one or a plurality of optical elements 24 being individually rotatably adjusted to alter the overall light dispersion or distribution pattern of the luminaire. To further emphasize this aspect of the invention, FIGS. 4A-4D illustrate a luminaire 30 including a housing 35 supported a pair of adjacent or side-by-side, adjustable optical elements 24A and 24B. Here, housing 35 is shown to be ceiling mounted and the illustrated light patterns are established on a floor beneath luminaire 30. As can be seen, one or more of optical elements 24A and 24B can be adjusted to alter the overall light dispersion pattern for the luminaire 30. More specifically, by way of example, FIG. 4A illustrates the default position for both optical elements 24A and 24B, wherein asymmetric optical element 24A has a 60 degree beam spread, providing a 15 degree (from the vertical) light throw on the left or shortened side as viewed in this figure and a 45 degree (from the vertical) light throw on the right or elongated side. On the other hand, optical element 24B presents basically a mirror image, thereby having a 45 degree left side throw and a 15 degree right side throw, both relative to vertical, to establish a certain light pattern 50A, such as on a floor beneath luminaire 30. FIG. 4B has optical elements 24A and 24B rotated by 180 degrees relative to the default position such that the inner light throws are at 15 degrees and the outer throws are at 45 degrees relative to vertical, thereby creating a different light pattern 50B. FIG.

Figure 4D:
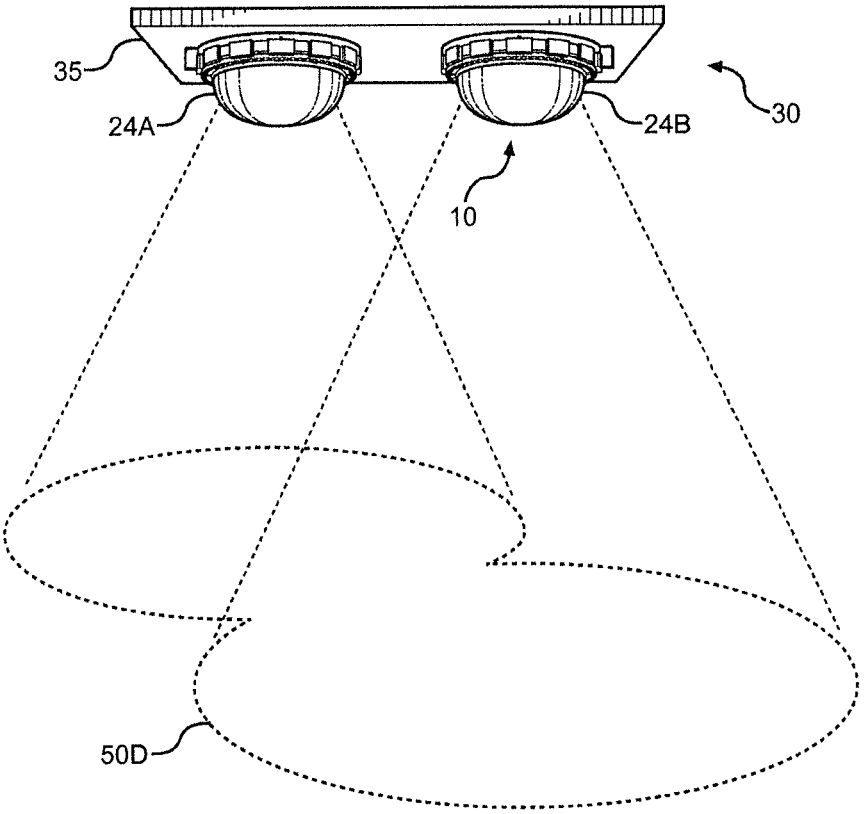

4C has optical element 24A in the default position and optical element 24B rotated by 180 degrees to establish a light pattern 50C which is essentially elongated in one direction. FIG. 4D has both optical elements 24A and 24B rotated 90 degrees counterclockwise from the default position to establish pattern 50D. In any case, it should be readily apparent from these exemplary arrangements that, by adjusting the aim of one or more of the asymmetrical optical elements 24A and 24B, different light dispersion or distribution patterns can be readily achieved. Of course, in accordance with the invention, the optical elements 24A and 24B are maintained in these established positions until repositioning is desired, with either an incremental or smooth adjustment being available and the adjustments can result in a broad variety of light distribution patterns for luminaire 30.

Based on the above, it should be readily apparent that the principles of the invention have been shown and described herein in connection with specific embodiments, but it is to be understood that such embodiments are by way of example, and are not limiting. For instance, although the drawings do not illustrate fasteners, or indicate the means of fastening, it is to be understood that the LED emitter is typically rigidly attached to the luminaire housing or a heat-sink. In embodiments where optics are dedicated to the apparatus described herein, the bezel can be a contiguous part of the optical element, and can be formed together with the optical element. This can be a highly advantageous feature in case the optical element is made of plastic material, and is injection molded. In addition, the position-indicating graphics might also be an integral feature of the bezel-comprising optical element, or can be provided as a separate dial. Furthermore, although examples are set forth with a luminaire including a pair of optical elements, it should be understood that there would typically be more than two optical elements in a given luminaire, with one or more of these optical elements being adjustable through the various features of the lighting unit. The various optical elements can assume various configurations. For instance, the various optical elements can be lined up along a straight line, extend along two or more parallel lines, provided around the circumference of a circle, arranged at points of a polygon, or positioned in many other arrangements. In particular, a single luminaire with a plurality of the lighting units, for example ranging from six to ten, can be adjusted to selectively create a wide range of distribution patterns commonly employed in various fields, such as outdoor lighting distribution patterns I-V as established by the IESNA (Illuminating Engineering Society of North America). Regardless, the invention provides for one or more optical elements of a luminaire to be asymmetrical and rotationally adjustable, specifically manually, in a simple and accurate manner, without the need for tools.

The invention claimed is:

1. A luminaire comprising:

a housing; and a plurality of lighting units mounted on or in the housing, at least one of said plurality of lighting units including:

an LED emitter rigidly mounted to the housing and including a light emitting surface;

a bezel mounted for rotation relative to the LED emitter;

an asymmetric optical element for projecting light from the LED emitter, said optical element being rigidly attached to the bezel, a ring fixed relative to both the housing and the LED emitter, with one of the housing and said ring including one of an indicator and graphic markings, and a position indicating dial provided on the bezel, with the position indicating dial including another of the indicator and the graphic markings, with the indicator being configured to be aligned with one of the graphic markings upon rotation of the bezel to indicate an angular interval of rotation of the bezel, wherein rotatable adjustment of the bezel causes angular adjustment of the optical element relative to the LED emitter to alter a light direction of light emitted from the at least one of the plurality of lighting units and thereby alter a light dispersion pattern of the luminaire.

2. The luminaire according to claim 1, wherein the bezel is concentrically positioned for rotation around a central axis of the at least one of said plurality of lighting units.

3. The luminaire according to claim 2, wherein the central axis is centered on and perpendicular to the light emitting surface of the LED emitter.

4. The luminaire according to claim 2, further comprising a wreath rigidly attached to the ring.

5. The luminaire according to claim 4, wherein the wreath is attached to a bezel-facing side of the ring, said luminaire further comprising: a detent mechanism acting between the wreath and bezel to retain the optical element in a desired rotational position.

6. The luminaire according to claim 5, wherein the detent mechanism includes at least one spring projection extending from the wreath which is received in one of a plurality of recesses provided about the bezel to retain the optical element in a selected rotational position.

7. The luminaire according to claim 6, wherein the detent mechanism constitutes a ratchet-type mechanism permitting rotation of the bezel.

8. The luminaire according to claim 2, wherein the bezel can be rotated up to 360 degrees to adjust the optical element.

9. The luminaire according to claim 2, wherein the position indicating dial includes the graphic markings corresponding to angular intervals of rotation of the bezel, said position indicating dial being configured to be aligned with the indicator which is provided on the ring.

10. A lighting unit comprising:

an LED emitter including a light emitting surface;

a bezel mounted for rotation relative to the LED emitter; and an asymmetric optical element for projecting light from the LED emitter, said optical element being rigidly attached to the bezel, wherein rotatable adjustment of the bezel causes angular adjustment of the optical element relative to the LED emitter to alter a light direction of light emitted from the lighting unit;

a ring fixed relative to and the LED emitter, said ring including one of an indicator and graphic markings, and a position indicating dial provided on the bezel, with the position indicating dial including another of the indicator and the graphic markings, with the indicator being configured to be aligned with one of the graphic markings upon rotation of the bezel to indicate an angular interval of rotation of the bezel.

11. The lighting unit according to claim 10, wherein the bezel is concentrically positioned for rotation around a central axis of the lighting unit relative to the ring.

12. The lighting unit according to claim 11, further comprising a wreath rigidly attached to the ring.

13. The lighting unit according to claim 12, wherein the wreath is attached to a bezel-facing side of the ring, said lighting unit further comprising: a detent mechanism acting between the wreath and bezel to retain the optical element in a desired rotational position.

14. The lighting unit according to claim 13, wherein the detent mechanism includes at least one spring projection extending from the wreath which is received in one of a plurality of recesses provided about the bezel to retain the optical element in a selected rotational position.

15. The lighting unit according to claim 11, wherein the bezel can be rotated up to 360 degrees to adjust the optical element.

16. The lighting unit according to claim 11, wherein the position indicating dial includes the graphic markings corresponding to angular intervals of rotation of the bezel, said position indicating dial being configured to be aligned with the indicator which is provided on the ring.

17. A method of adjusting optics of a lighting unit including an LED emitter having a light emitting surface and an asymmetric optical element comprising:

rotating a bezel relative to a fixed LED emitter, wherein rotatable adjustment of the bezel causes angular adjustment of the optical element relative to the LED emitter to alter a light direction of light emitted from the lighting unit; and aligning an indicator, provided on one of a ring fixed relative to the LED emitter and a position indicating dial provided on the bezel, with graphic markings, provided on another of the ring and the position indicating dial, upon rotation of the bezel to indicate an angular interval of rotation of the bezel.

18. The method of claim 17, further comprising: rotating the bezel up to 360 degrees to adjust the optical element.

19. The method of claim 17, further comprising: retaining the optical element in a desired rotational position with a detent mechanism wherein the detent mechanism acts between a wreath rigidly attached to the ring and the bezel to retain the optical element in a desired rotational position.

20. The method of claim 17, further comprising: providing a plurality of said lighting units on or in a housing of a luminaire and altering an overall light dispersion pattern for the luminaire by rotatably adjusting the optical element of at least one of the plurality of lighting units.

* * * * *